United States Patent [19]

Ladd, Jr. et al.

[11] Patent Number: 4,652,162

[45] Date of Patent: Mar. 24, 1987

[54] COSMETIC POWDER DISPENSER AND APPLICATOR

[75] Inventors: James E. Ladd, Jr., Rowayton; David R. Jacobs, Norwalk, both of Conn.

[73] Assignee: Laura Lupton Inc., Rowayton, Conn.

[21] Appl. No.: 780,072

[22] Filed: Sep. 25, 1985

Related U.S. Application Data

[63] Continuation-in-part of Ser. No. 752,133, Jul. 5, 1985.

[51] Int. Cl.[4] ..... A46B 11/00; A46B 11/04

[52] U.S. Cl. ..... 401/123; 132/81; 132/82 R; 132/82 G; 401/82; 401/99; 401/125; 401/191; 401/270; 401/280

[58] Field of Search ..... 401/281, 99, 123, 124, 401/125, 135, 82, 191, 280, 270; 132/82 R, 82 G, 81

[56] References Cited

U.S. PATENT DOCUMENTS

| | | | |
|---|---|---|---|
| 1,054,229 | 2/1913 | Methven | 132/81 |
| 1,172,293 | 2/1916 | Kohlhepp | 132/82 G |
| 1,183,680 | 5/1916 | Sauer, Jr. | 401/280 X |
| 1,274,697 | 8/1918 | Dynowsky | 401/123 X |
| 1,588,633 | 6/1926 | Taylor | 401/123 X |
| 2,480,331 | 8/1949 | Lecker | 401/125 |
| 2,625,302 | 1/1953 | Mahoney | 401/280 X |
| 3,061,868 | 11/1962 | Miller | 401/135 |

*Primary Examiner*—Steven A. Bratlie

[57] ABSTRACT

A hollow elongated capsule containing cosmetic powder slides removably into an open end of a first elongated hollow member. The other end of the first member has a plurality of spaced openings. A second hollow elongated member has two opposite ends, one of which engages the other end of the first member. A plate disposed in the second member intermediate its ends has openings aligned with the first member openings. An element slidably disposed in the second member has openings which can be moved into alignment with the plate and member openings or which can be moved out of such alignment. A brush having parallel bristles with powder applying tips is disposed in the third member with the tips disposed adjacent the second member. The brush and third member have manually operated cooperating elements for establishing a first position at which the bristles extend almost entirely out of the third member and a second position at which the bristles are disposed within the third member.

4 Claims, 6 Drawing Figures

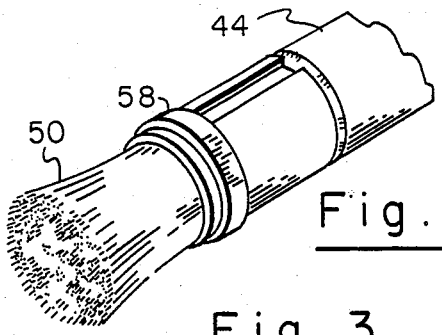
Fig. 6
Fig. 3
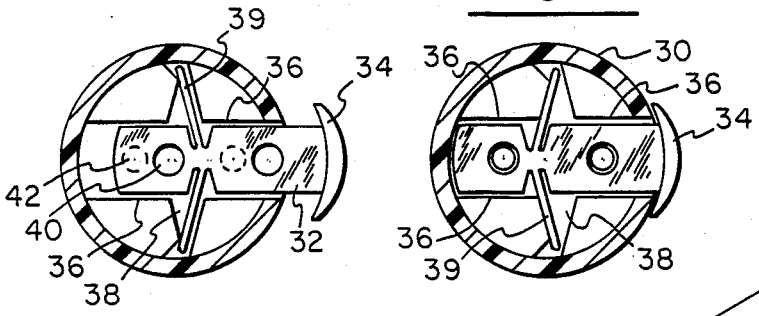
Fig. 2
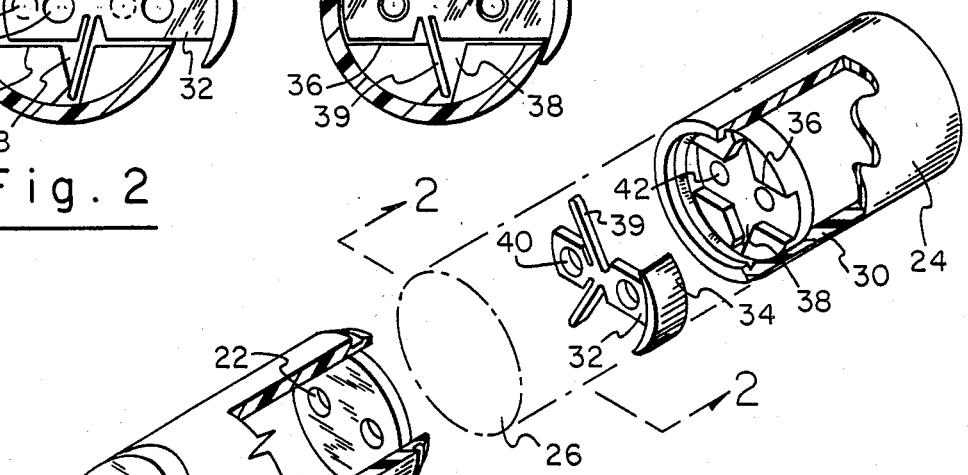
Fig. 1
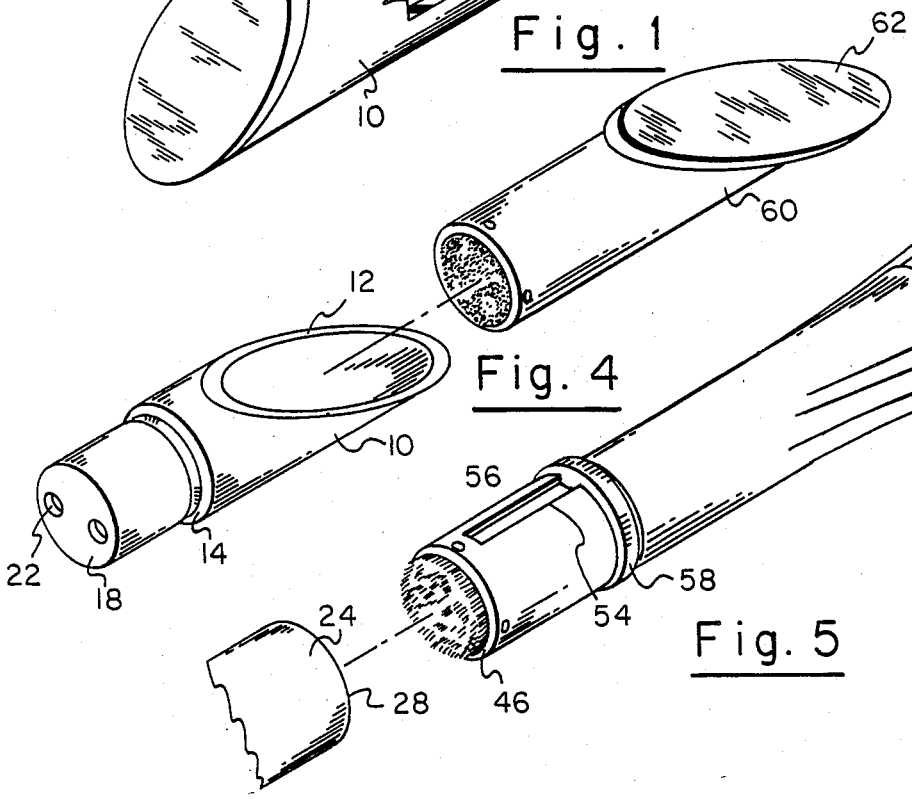
Fig. 4
Fig. 5

COSMETIC POWDER DISPENSER AND APPLICATOR

CROSS REFERENCE TO COPENDING APPLICATION

This application is a continuation-in-part of copending application entitled "Cosmetic Powder Dispenser and Applicator", filed July 5, 1985, Ser. No. 752,133, now allowed.

BACKGROUND OF THE INVENTION

The copending application Ser. No. 752,133 discloses a cosmetic powder dispenser and applicator in which first and second members have a first position of relative rotation at which openings in the two members are aligned and powder can flow through the aligned openings onto a brush for application by the user. These members have a second position of relative rotation at which this powder flow is blocked. The present invention is directed to this type of powder dispenser and applicator wherein the two members are not relatively rotatable but instead a mechanism is employed wherein transverse movement is employed to either allow or block powder flow.

SUMMARY OF THE INVENTION

In accordance with the principles of the invention, a cosmetic powder dispenser and applicator employs a first elongated hollow member having first and second opposite ends. The first end is open. The second end is closed and has a plurality of small spaced apart openings therein. An elongated capsule adapted to be filled with cosmetic powder is closed at one end and open at the other. The capsule is removably slidable into and out of the first member. The capsule, when inserted in the first member, has its open end adjacent the second end of the first member and its closed end closing the first end of the first member.

A second hollow elongated member has a first and second opposite open ends, the first end being secured to the second end of the first member. The second member contains between its ends a plate having openings aligned with the openings in the first member. An element extends transversely to the direction of elongation into the second member in a position adjacent the plate but disposed between the plate and the second end of the first member. This element is manually slidable back and forth between a first position at which each of a like plurality of openings in the element are aligned with the openings in the plate and the openings in the first member and a second position at which the openings in the element are out of alignment with the other openings.

A third elongated hollow member has an open end detachably engaging the second end of the second member and has an opposite closed end. A brush has a plurality of essentially parallel bristles with powder tips. The brush is disposed in the third member with these tips adjacent the second member. The brush and the third member have manually operated cooperating elements for establishing a first forward position at which the bristles extend almost entirely out of the third member and a second withdrawn position at which the brush is disposed within the third member.

In use, the dispenser and applicator is disposed vertically with the first member disposed above the second member and the brush is disposed within the third member. The element is then moved into the first position whereby, when powder is in the capsule, the powder flows downwardly through the aligned holes onto the tips of the bristles. When sufficient powder has been applied to the tips, the element is moved into the second position whereby the flow of powder ceases. The third member is then detached from the second member and the brush is moved into the first forward position. By using the third member as a handle, the user can apply the powder as needed.

BRIEF DESCRIPTION OF THE DRAWINGS

FIG. 1 is a perspective exploded detail view of the capsule, first member, second member and slide element.

FIG. 2 is a detail view showing the position of the slide element when blocking powder flow.

FIG. 3 is a view similar to FIG. 2 but showing the position of the slide element when allowing powder flow.

FIG. 4 is a perspective exploded view of the capsule and first member.

FIG. 5 is a perspective exploded view showing the brush, third member and the connection between the second and third members.

FIG. 6 shows the brush in extended position.

DETAILED DESCRIPTION OF PREFERRED EMBODIMENTS

Referring to FIGS. 1–6, a first elongated hollow cylindrical plastic member 10 has one open end 12 which lies in a plane disposed at an acute angle with respect to the direction of elongation and has the shape of an ellipse. Member 10 has a shoulder 14 intermediate the ends and an extension of smaller diameter which terminates in the opposite end 18 of this member. End 18 is closed and has a plurality of spaced apart small openings 22 therein.

A second elongated hollow cylindrical member 24 has opposite open ends 26 and 28. Member 24 engages the small diameter extension whereby end 26 abuts end 18. Member 24, intermediate its ends, has a plate 30, disposed at right angles to the direction of elongation, with openings 42 aligned with openings 22. Member 24 has a single larger opening in its side wall between end 26 and plate 30, immediately adjacent plate 30, in which transversely extending element 32 is disposed. An enlarged end 34 of element 32 is located on the outside of member 24. Plate 30 has extensions 36 which define a horizontally confined slide path for the element. These extensions also define a vertical groove 37 in which vertically elongated arms 38 are disposed. These arms can be leaf springs whereby the element is normally in the position shown in FIG. 2 unless the end 34 is pushed inward and held in the position shown in FIG. 3. Element 32 is slidably held in place in front of the plate. Element 32 has openings 40. When the element is in its normal position, openings 40 are out of alignment with openings 22 and 42 whereby powder cannot flow therethrough. When the end 34 is pushed inwardly, openings 40 are aligned with openings 22 and 42 whereby powder can flow therethrough.

A third hollow elongated plastic member 44 has one open end 46 and an opposite closed end. End 46 can be removably inserted into end 28 of the second member. A brush 48 with essentially parallel bristles 50 having tips 52 is slidably disposed in the open end 46 of member 44. That portion of member 44 adjacent end 46 has two oppositely disposed longitudinally extending slots 54, only one of which is visible in the drawing.

The outer surface of the brush has two oppositely disposed elongated runners 56, each runner riding in a corresponding slot 54. The runners are secured at one end to ring 58 which is also the base for the bristles.

The brush can be slid foward so that the bristles are almost entirely exposed, or can be withdrawn so that the brush is disposed within the third member. The positions of the slots and runners are such that the brush is always secured to member 44 which can act as a brush handle.

A hollow elongated plastic capsule 60 can be filled with cosmetic powder and slidably and removably inserted into member 10 via its open end. The capsule has a closed transparent end 62 which meets the open end of member 10 in flush engagement. The opposite end of the capsule is open and abuts the opposite closed end of member 10. Since end 62 is transparent, the user can determine visually how much powder remains to be used. The capsule can contain cosmetic powder. The structure can then be used as previously described.

What is claimed is:

1. A cosmetic powder dispenser and applicator comprising:

a first elongated hollow member having a first open end and an opposite closed end with a plurality of small spaced openings therein;

a hollow elongated capsule, adapted to be filled with cosmetic powder, closed at one end and open at the other and removably slidable into and out of the first member, the capsule, when inserted in the first member, having its open end adjacent the second end of the first member and its closed end closing the first end of the first member;

a second elongated hollow member having first and second open ends, the closed end of the first member being secured to the first open end of the second member, said second member having a plate therein disposed at right angles to the direction of elongation intermediate the ends of the second member, the plate having openings aligned with the openings in the first member;

means having openings and disposed in the second member between the plate and the first end of the second member, said means being movable in a direction transverse to the direction of elongation between a first position at which the means openings are aligned with the plate and first member openings and a second position at which the means openings are not so aligned;

a third elongated hollow member having an open end detachably engaging the second end of the second member and having an opposite closed end; and a brush having a plurality of essentially parallel bristles with powder applying tips, the brush being disposed in the third member with the tips adjacent the second member, said brush and said third member having manually operated cooperating means for establishing a forward position at which the bristles will extend almost entirely out of the third member, and a withdrawn position at which the brush is disposed within the third member.

2. The dispenser and applicator of claim 1 wherein the means slidably engages the plate.

3. The dispenser and applicator of claim 2 wherein the means is an element with an enlarged head disposed outside of the second member.

4. The dispenser and applicator of claim 3 wherein the plate is provided with means for engaging the element, said plate means including a vertical groove, said element having arms disposed in said groove.

* * * * *